United States Patent [19]

Heiman

[11] 4,234,070

[45] Nov. 18, 1980

[54] VENDING CONTROL APPARATUS

[75] Inventor: Frederic P. Heiman, Philadelphia, Pa.

[73] Assignee: Mars, Inc., McLean, Va.

[21] Appl. No.: 843,287

[22] Filed: Oct. 18, 1977

[51] Int. Cl.[2] ..... G07F 11/00

[52] U.S. Cl. ..... 194/1 N; 194/10; 221/125

[58] Field of Search ..... 194/1 N, 1 R, 2, 10; 221/125, 129; 361/193, 196; 340/168 R, 168 B, 168 CC

[56] References Cited

U.S. PATENT DOCUMENTS

| | | | |
|---|---|---|---|
| 3,307,671 | 3/1967 | Shirley | 194/10 |
| 3,508,636 | 4/1970 | Shirley | 194/10 |
| 3,532,203 | 10/1970 | Clift | 194/10 |
| 3,691,431 | 9/1972 | Hendrickson et al. | 221/125 UX |
| 3,826,955 | 7/1974 | Fest | 361/196 |
| 4,034,839 | 7/1977 | Lee | 194/1 N X |

*Primary Examiner*—Joseph J. Rolla
*Assistant Examiner*—Edward M. Wacyra
*Attorney, Agent, or Firm*—Davis, Hoxie, Faithfull & Hapgood

[57] ABSTRACT

Control apparatus for use in a vending machine having actuators individually controlled for dispensing customer selected products. The control apparatus generally includes a credit indicating system, a price indicating system, a calculating section for comparing the customer credit with the price of the selected product category, a selection circuit for generating the internal signals indicative of which product category was selected, and actuator controls for activating the corresponding actuator to dispense the selected product. Disclosed selection circuits include a circuit having a plurality of comparator circuits to form a latching system; and another having a pulse counter with a plurality of output terminals sequentially activated in response to a clock signal, along with detectors such as optical couplers to generate a signal indicative of which product category was selected. An actuator control includes electronic power switches for use with systems having an alternating current power supply with one output terminal connected to the actuators and another output terminal connected to a common terminal, the electronic power switch activating the corresponding actuator by connecting the actuator to the common terminal.

26 Claims, 5 Drawing Figures

VENDING CONTROL APPARATUS

This invention relates to vending machine control systems for controlling actuators used in dispensing customer selected products. In a typical vending machine the selected product is dispensed by activating an actuator, such as a motor or relay, when various vend criteria such as product availability, customer payment, and correct change availability have been satisfied. The control system is used to identify which product has been selected, ascertain whether the vend criteria have been satisfied, and to accordingly cause the activation of the corresponding actuator to dispense the desired product.

The prior art has presented various systems for performing these tasks inherent in the vending process. Of relevance to the present invention are those elements of the prior art control systems which generate the internal electrical signals indicative of which product is to be vended, and those elements used in achieving the activation of the corresponding actuator.

In activating the actuator to dispense the desired product, prior art vending machines have generally electrically isolated the actuators from the control system circuitry for the purpose of protecting the control circuitry from the higher voltages powering the actuators. Coupling between the circuits has been generally achieved in the prior art through the use of relays or optical couplers. The present invention in providing apparatus precluding the need for such electrical isolation avoids the need for such relays or optical couplers, achieving both a reduction in cost as well as the increased reliability attendant in the elimination of the mechanical relays.

Prior art vending systems have also provided various apparatus for detecting which product has been selected and generating the appropriate identifying signals for use by other elements of the control system. The present invention provides new and advantageous control apparatus for performing this function with either isolated systems, such as found in the prior art, or non-isolated systems as in the present invention.

Control apparatus is presented for use in a vending machine having a plurality of actuators individually controlled for the dispensing of customer selected products and having selection switches which generate switch signals in response to customer selection of the desired product. In the control apparatus, the selection circuit indicates to the rest of the control circuit which product category was selected; the credit indicating section produces a signal indicative of the credit to be accorded to the customer; the price indicating section produces a signal indicative of the price of the customer selected product category; the calculating section compares the amount of customer credit with the price of the selected product category; and the actuator control causes the corresponding actuator to become activated and dispense the selected product.

In the non-isolated systems, alternating current actuators are used with the alternating current power supply having its first output terminal connected to the corresponding actuator and its second output terminal connected to a common terminal. In such non-isolated systems, the actuator control includes an electronic power switch which activates the corresponding actuator by connecting the actuator to the common terminal, thereby completing its connections to the power supply.

A selection circuit is provided for use in nonisolated systems, the circuit containing a plurality of comparator circuits in forming a latching system. The system generates a selection signal indicative of which product category is to be dispensed in response to the first switch signal received, and is thereafter latched against generating any subsequent signals until the machine is prepared for another selection.

Another selection circuit for use in either isolated or non-isolated systems contains a pulse step counter for generating a selection signal in response to the first switch signal received. A clock signal sequentially activates the plurality of output terminals of the step counter until the output terminal corresponding to the selected product category is reached. A detector, such as an optical coupler, generates a signal indicating that the corresponding output terminal has been activated and halting the stepping of the counter.

This vending control apparatus can be employed in association with the exact change indicator described in my co-pending application, Ser. No. 843,286, filed on the same date as this application, Oct. 18, 1977.

DETAILED DESCRIPTION OF THE INVENTION

Figure 1:
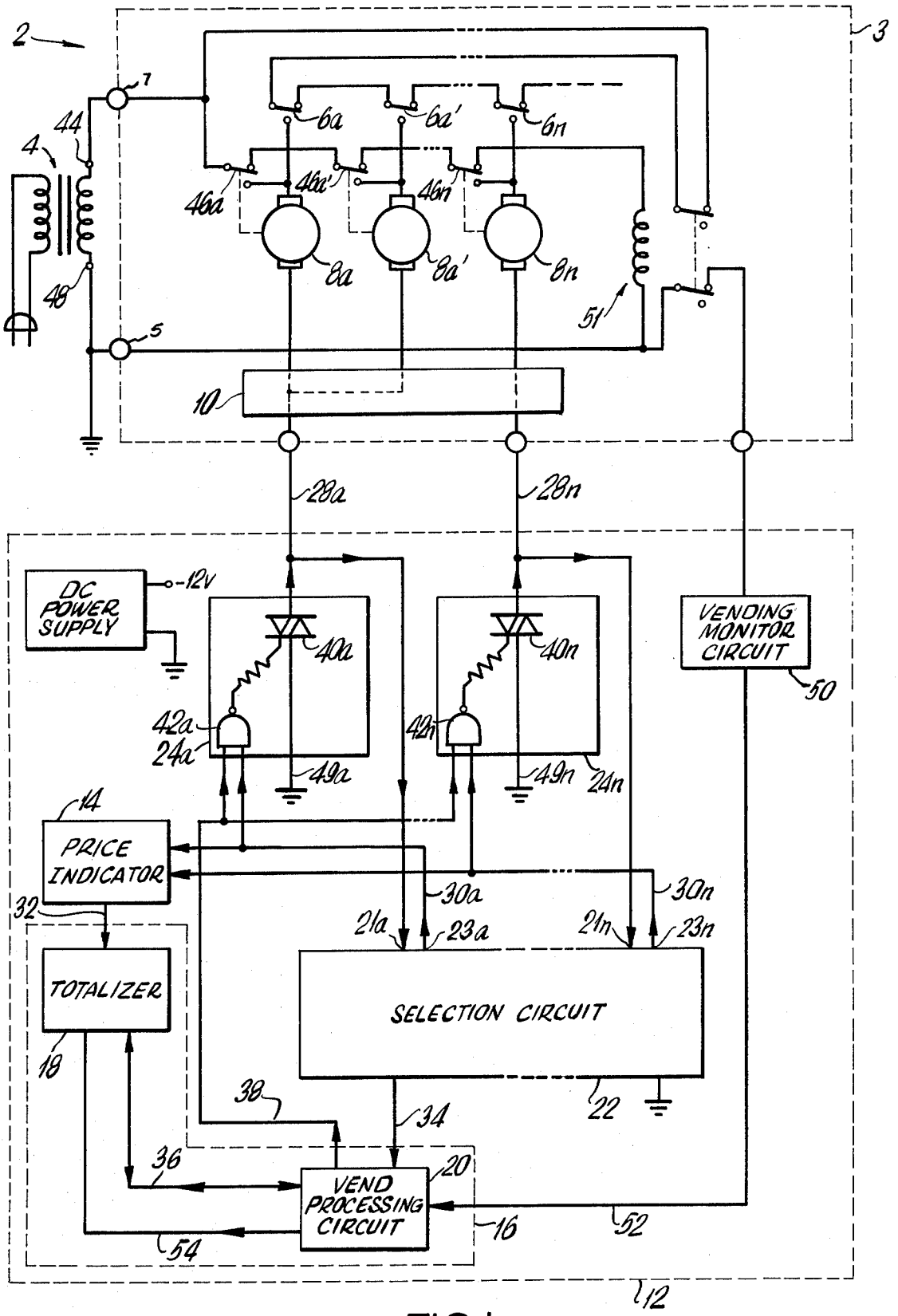
FIG. 1 shows a vending machine including a control apparatus 12 generally in block diagram, with an alternating current power supply, selection switches, and electric motor

FIG. 1 illustrates a vending machine 2 having an alternating current power supply 4 in the form of a step-down line transformer, a plurality of selection switches 6 (a–n), a plurality of actuators 8 (a–n) here in the form of alternating current electric motors, a matrix box 10 and control apparatus 12 for controlling the actuators to dispense the selected product.

The control apparatus 12 has a price indicating means 14 here in the form of a pricing circuit, for producing a signal indicative of the price of the customer selected product; a calculating section 16, here in the form of a totalizer 18 and a vend processing circuit 20, for comparing the amount of customer credit with the price of the selected product; a selection circuit 22 for generating a selection signal indicating which product category was selected; actuator controls 24 (a–n) for activating the actuator 8 (a–n) corresponding to the selected product to dispense the product; and a vending monitor circuit 50 for indicating when the vending operation is taking place.

In operation, a selection switch, such as switch 6a of FIG. 1, generates a switch signal in response to selection by a customer of a desired product. While a conventional pushbutton switch is illustrated in the embodiment of FIG. 1, other types of switches and other switching apparatus could be used. The switch signal is carried into an optional matrix box 10 of conventional design wherein the switches 6 (a–n) and actuators 8 (a–n) for products of a common category can be connected to a common output, the outputs carried along lines 28 (a–n). For example, in the illustrated embodiment the actuators 8*a* and 8*a'* for products selling for the same price are interconnected within the matrix to a common output, with those actuators associated with a first price being connected to line 28*a*. Actuator 8*n*, associated with a second price, is connected to line 28*n*. Wiring the switches 6 (a–n) in series precludes a customer from deceiving the machine into vending too many products of the same category, since the pressing of one button severs the remainder of the buttons from the series circuit.

The product category switch signals along lines 28 (a–n) are carried to the actuator control circuits 24 (a–n) and to the selection circuit 22. The selection circuit 22 receives the switch signal at inputs 21 (a–n) and in response generates a selection signal at outputs 23 (a–n) along lines 30 (a–n) indicative of the category of the selected product. This selection signal is received by the pricing circuit 14 which in response produces a signal indicative of the price of the selected product along line 32 to the totalizer 18. The selection circuit 22 also generates a selection made signal along line 34 to the vend processing circuit 20, indicating that a selection has been made without indication of the nature of the selection.

In the calculating section 16, the vend processing circuit 20 receives the selection made signal from the selection circuit 22 and in response transmits a signal via line 36 to the totalizer 18. In response, the totalizer 18 operates conventionally to calculate the customer credit as, for example, by recording the money paid into the machine or by other means of receiving a credit indication. The totalizer further compares the amount of customer credit with the price of the selected product received from the pricing circuit 14, and, if sufficient, transmits a signal via line 36 to the vend processing circuit 20. In response, the vend processing circuit 20 transmits a vend signal along line 38 to the actuator circuits 24 (a–n).

In the FIG. 1 embodiment, the actuator controls 24 (a–n) each comprise an electronic power switch 40 (a–n) and an NAND gate 42 (a–n). The combination of the vend signal on line 38 from the calculating section 16 and the selection signal on one of the lines 30 (a–n) from the selection circuit 22 switches the corresponding NAND gate 42 (a–n) and activates the corresponding power switch 40 (a–n). For example, a selection signal on line 30*a* from output 23*a* of the selection circuit 22 and a vend signal on line 38 would switch AND gate 42*a*, causing the activation of the power switch 40*a*, activating one of the corresponding actuators 8 (a–n) as explained below.

In the illustrated system, the actuators 8 (a–n) are not electrically isolated from the control system 12, and all these elements are powered by the alternating current power supply illustrated as a step down line transformer 4. First output terminal 48 of the transformer output is connected to a common terminal 5, such as to a ground. Similarly, the electronic power switches 40 (a–n) are connected on one side to the common terminal 5 by lines 49 (a–n). Second output terminal 44 of the transformer output is connected by switches 6 (a–n) and, as explained below, by switches 46 (a–n) to the actuators 8 (a–n). When a power switch, such as 40*a*, is activated by the switching of its NAND gate, 42*a* in this example, the corresponding actuator 8*a* is thereby connected to the common terminal through lines 28*a* and 49*a* and the interconnections in the matrix box 10. Assuming that actuator 8*a'* corresponds through the matrix box to power switch 40*a*, the activation of power switch 40*a* in the above example would activate actuator 8*a'* by completing the electrical connection through the matrix box 10, the actuator 8*a'*, and switch 6*a'* to output terminal 44 of the power supply. Once the actuator is activated, the corresponding switch 46 (a–n) is mechanically activated by a cam or other conventional means to maintain the electrical connection between the actuator and terminal 44 even after the selected switch among switches 6 (a–n) is released by the customer and returns to its normal position. For example, once actuator 8*a'* is activated as a result of the customer pressing switch 6*a'*, switch 46*a'* is activated by the actuator and the actuator 8*a'* continues to be powered even though the customer thereafter releases switch 6*a'*.

During the period when the actuator is operating, the vending monitor circuit 50 conventionally by means of relay 51 produces a vending-in-progress signal along line 52 to the vend processing circuit 20 in the calculating section 16. In response, the vend processing circuit 20 instructs the totalizer 18 along line 54 to collect the price of the product being vended and to return any appropriate change. The continuation of the vending-in-progress and selection made signals causes the vend processing circuit 20 to continue to generate the vend signal on line 38 until the product has been completely vended. When the vending is completed, the vendinginprogress signal is terminated, the vend signal along line 38 is terminated, and the activated power switch 40 (a–n) is deactivated. Also, while the power switch 40 (a–n) was activated, the corresponding line of lines 28 (a–n) had been connected to ground, maintaining a ground input into the corresponding terminal 21 (a–n) of the selection circuit 22, thereby maintaining the selection and selection made outputs from the selection circuit 22. When the activated power switch is deactivated at the end of vending, the signal is removed from the corresponding line of lines 28 (a–n), thereby causing the selection circuit 22 to terminate the selection and selection made outputs and preparing the control apparatus 12 to process a new selection.

Figure 3:
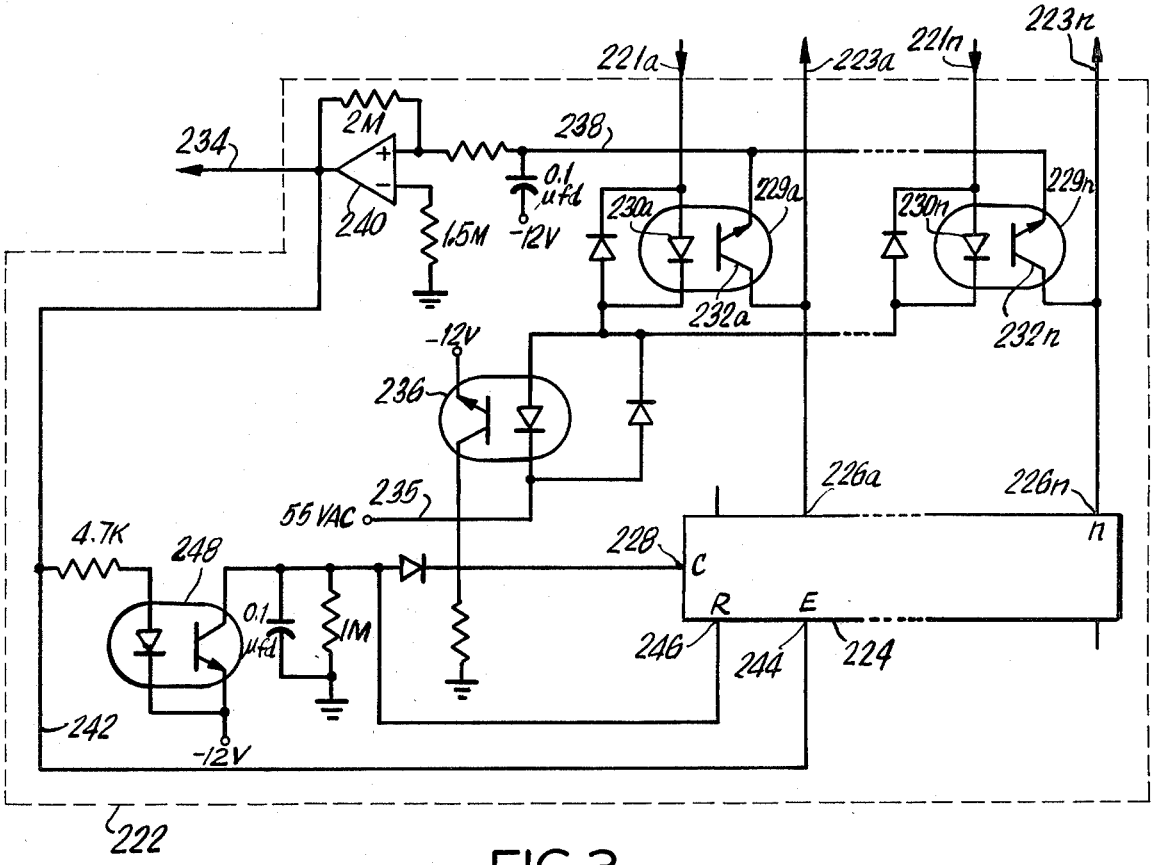
FIG. 3 is a schematic diagram of a step counter selection circuit 222 having a pulse counter, which can be used as the selection circuit 22 of the control apparatus of FIG. 1.
Figure 4:
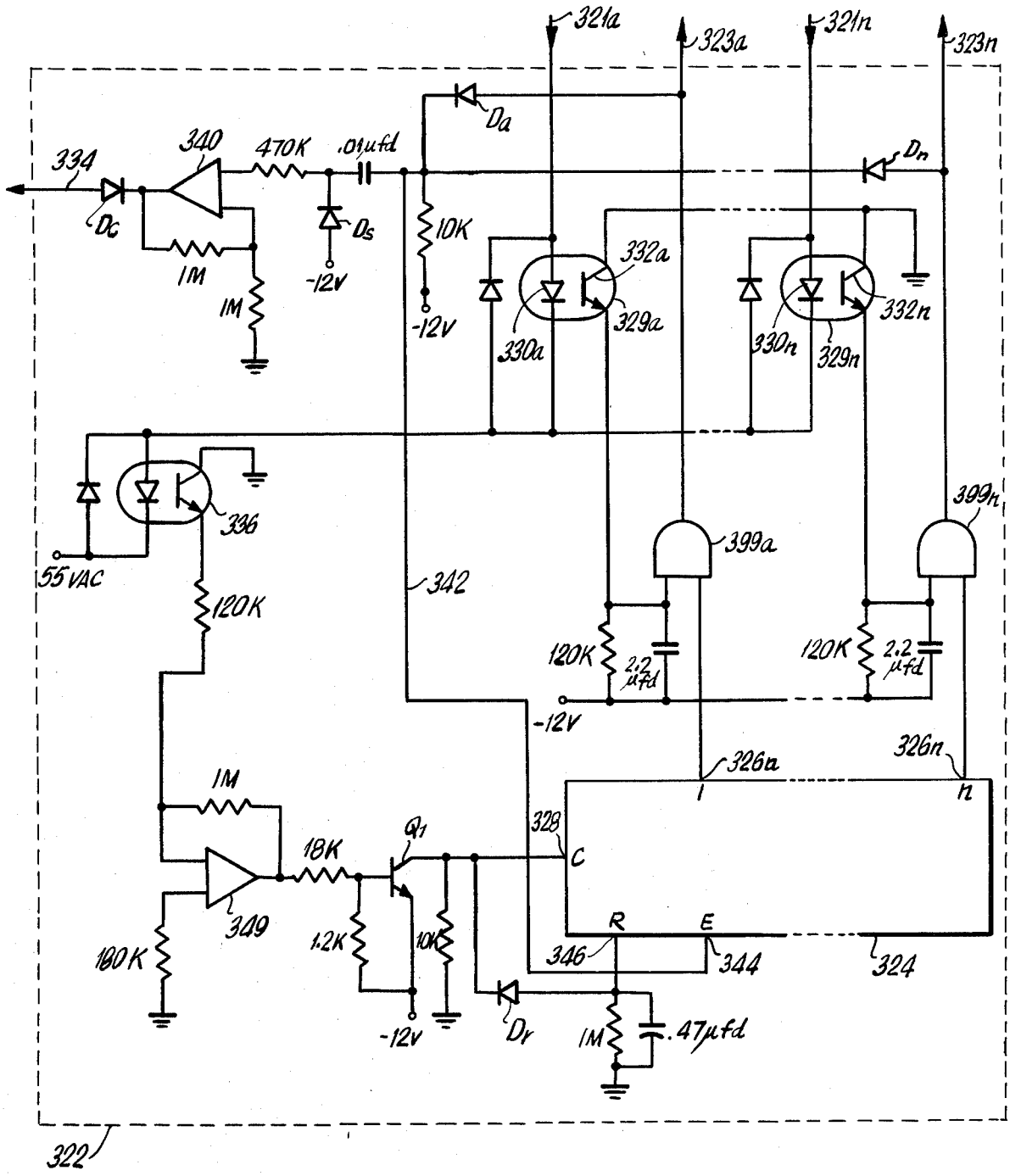
FIG. 4 is a schematic diagram of a selection circuit 322, a variation of the step counter selection circuit 222 of FIG. 3.

Several possible circuits can perform the selection circuit 22 function of receiving the switch signals and in response generating a selection signal indicating which product category was selected and a selection made signal indicating which product category was selected and a selection made signal indicating that a selection has been made. Three preferred embodiments are illustrated in FIGS. 2, 3 and 4.

Figure 2:
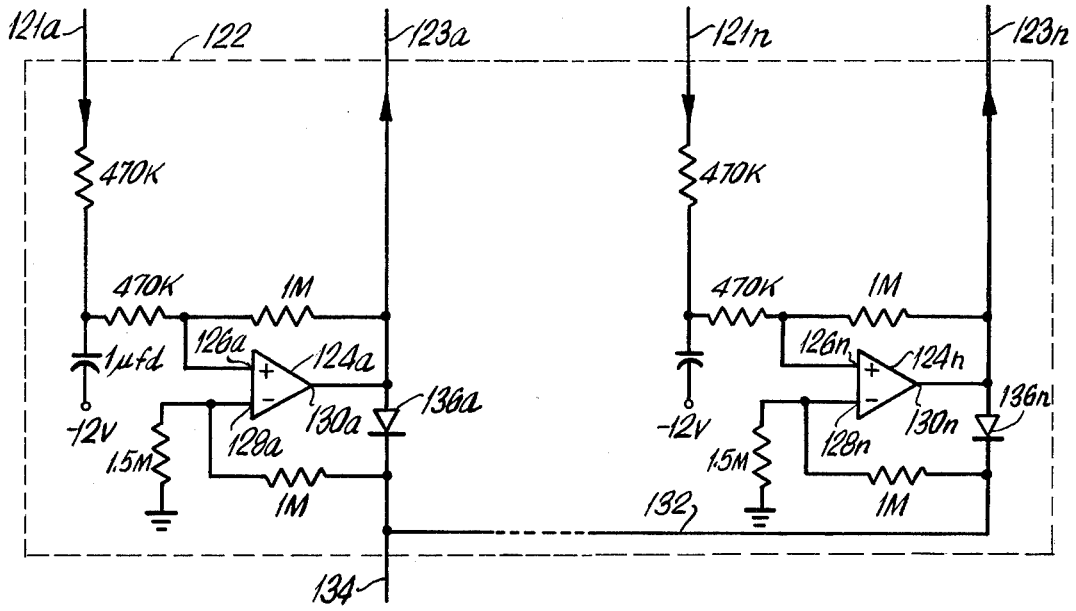
FIG. 2 is a schematic diagram of a latching selection circuit 122 having a plurality of comparators, which can be used as the selection circuit 22 of the control apparatus of FIG. 1.

In FIG. 2, a selection circuit 122 has selection circuit inputs 121 (a–n) corresponding to inputs 21 (a–n), selection signal outputs 123 (a–n) corresponding to outputs 23 (a–n) and selection made output line 134 corresponding to output line 34. The circuit 122 comprises a plurality of comparator circuits 124 (a–n), each comparator circuit having a first, positive input 126, a second, negative input 128 and an output 130.

Before a selection is made by the customer, inputs 121 (a–n) are all open circuited. In this condition the bias current at the negative inputs 128 (a–n) of the comparators resulting from the 1.5 megohm resistors to ground dominates and the comparators 124 (a-n) each produce a low signal at their outputs 130 (a–n), in this embodiment a −12 volts D.C. output.

When a switch 6 (a–n) is activated by a customer in selecting a product, the resultant product category switch signal at the corresponding selection circuit input 121 (a–n) grounds that input and causes the corresponding comparator to generate a selection signal by altering its output from a first level of output, to a second level of output. In the embodiment illustrated, the output at corresponding terminal 130 (a–n) goes from the initial low of −12 volts D.C. to a high ground, which is the same as the ground of the vending section 3. Specifically, when a switch signal at input 121*a*, for example, drives that input to ground, the two 470 kilohm resistors and the one ufd capacitor form a filter which blocks alternating current from reaching the comparator 124*a*. Since the 940 kilohm total resistance to ground on the positive input 126*a* of the comparator is less than the 1.5 megohm resistance to ground on its other input 128*a*, the bias current on the positive input 126*a* of that comparator dominates and the signal at the output 130*a* switches to a high signal of ground potential. This output over line 123*a* constitutes a selection signal for the remainder of the control apparatus 12 and also adds additional bias via the 1 megohm resistors to both the positive input 126*a* and the negative input 128*a* of the comparator 124*a*. This output over line 134 constitutes a selection made signal.

This change in the output of the first comparator to receive a switch signal inhibits the other comparator circuits from generating any further selection signals since the outputs 130 (a–n) of the comparator circuits are interconnected with their second inputs 128 (a–n). Specifically, in the above example the high signal at output 130*a* is transmitted to all second inputs 128 (b–n) of the other comparators via line 132, resulting in additional bias at those inputs. The first inputs 126 (b–n) of the other comparators are blocked from receiving the additional bias by blocking diodes 136 (a–n). Overall, the additional bias on the negative inputs 128 (b–n) of the remaining comparators provided via line 132 blocks them from operation in the event that a subsequent switch signal is received on any of their corresponding inputs 121 (b–n) because the bias provided by connecting a 1 megohm and a 1.5 megohm resistor to ground will dominate over the 940 kilohm bias which would be provided if an additional switch 6 (b–n) were activated after an initial selection had been made.

In FIG. 3, a selection circuit 222 has selection circuit inputs 221 (a–n) corresponding to inputs 21 (a–n) selection circuit outputs 223 (a–n) corresponding to outputs 23 (a–n) and a selection made output line 234 corresponding to output line 34. The circuit 222 comprises a step counter 224 here in the form of a pulse counter with a plurality of output terminals 226 (a–n) sequentially activated in response to a clock signal input at clock terminal 228. The pulse counter 224 of the illustrated embodiment is of the type 4017 10 stage CMOS counter as made by RCA, Motorola and others.

Each selection circuit input 221 (a–n) has a corresponding optical coupler 229 (a–n) of a light emitting diode (LED) emitter 230 (a–n) and a photo transistor detector 232 (a–n). When a selection switch 6 (a–n) is activated by a customer, the resultant product category switch signal at the corresponding input 221 (a–n) connects that input to one side of the alternating current supply and causes alternating current from wire 235 to flow through an LED portion of a clock optical coupler 236 and through the LED portion 230 (a–n) of the corresponding selection optical coupler, causing both of these LED's to flash at the frequency of the alternating current. The detector portion of the clock optical coupler 236 responds by periodically switching on its transistor portion which functions as a clock pulse source for the counter 224, with the clock pulses at input 228 driving the counter 224 up one number for each cycle of the alternating current.

When the counter 224 counts, it connects its outputs 226 (a–n) to the one side of the alternating current supply in sequence from their normally low, negative voltage state. When the counter 224 reaches its output corresponding to the coupler 229 (a–n) whose LED portion 230 (a–n) is being activated by the presence of a switch signal, a pulse is produced on line 238. This pulse is stretched to approximately 0.1 second in duration by the RC circuit of a 1 megohm series resistor and a 0.1 ufd capacitor to a −12 volt source.

This 0.1 second stretched pulse on line 238 is applied to the positive input of a selection made comparator 240 which causes a high signal to appear at the comparator output as the selection made signal on line 234. Specifically, since the 1 megohm resistor in the positive input of the comparator 240 is smaller than the 1.5 megohm resistor from its negative input to ground, the bias on the positive input dominates and the output goes high. A 2 megohm feedback resistor is provided around the comparator to reduce sensitivity to electrical noise.

The selection made signal on line 234 is also carried on line 242 to enable input 244 of the counter, causing it to stop counting and hold at the count corresponding to the selection made. Accordingly, the selection signal at the held terminal 226 (a–n) appears as a high signal on the corresponding line 223 (a–n).

The selection circuit 222 will generate the selection made signal on line 234 and selection signal on one of lines 223 (a–n) so long as one of lines 221 (a–n) remains connected to one side of the alternating current supply. This happens when either a selection switch 6 (a–n) remains activated or an actuator activated switch 26 (a–n) remains activated during the dispensing of the product. When no line 221 (a–n) is connected to one side of the alternating current supply, the selection made and selection signals are terminated and the counter 224 is reset by an input at reset terminal 246 through the operation of reset coupler 248.

FIG. 4 shows a selection circuit 322 which is a variation of the selection circuit 222 of FIG. 3. Elements in the circuit of FIG. 4 which correspond to those in FIG. 3 are similarly numbered except for the substitutions of the prefix "3" for the prefix "2". Since the selection circuit 222 has already been described, only the principal differences between circuit 222 and circuit 322 will be discussed here, as the remainder will be clear from the drawings.

In circuit 322, AND gates 399*a*–399*n* have been added between counter outputs 326*a*–326*n* and wires 323*a*–323*n* to provide a stronger output signal on wires 323*a*–323*n* and improve the signal to noise ratio.

The 120 kilohm resistor and 2.2 ufd capacitor connected in parallel from one input of each of the AND gates 399*a*–399*n* form peak detectors which provide a direct current signal to an AND gate input terminal when the corresponding vending machine selection switch 6*a*–6*n* is closed. When an output is provided from the counter 322 to the other input of the same AND gate, that AND gate produces an output signal.

The functions of the optical couplers 329*a*–329*n* and 336 in the circuit 322 is analogous to that of the optical couplers 229*a*–229*n* and 236 in circuit 222.

The output of each of the AND gates 399*a*–399*n* is connected to one diode of a set of diodes D*a*–D*n*, which together with the associated 10K resistor −12 volts form an OR gate. The output of this OR gate is connected by wire 342 to the enable input 344 of the counter 324, and to the negative input of the selection made comparator 340 in a filter comprising a 0.1 ufd capacitor and a 470 kilohm resistor. The connection between the 0.1 ufd capacitor and the 470 kilohm resistor to −12 volts includes a diode Ds to protect the comparator 340. The diode Dx at the output of the comparator 340 is a blocking diode used to keep the comparator 340 from loading other signals within the calculating section 16.

Additional power and fast rise time clock pulses are provided in the clock section by the addition of an amplifier comprising comparator 349 operating as a buffer amplifier, and a transistor Q (such as a type 2N4424) following the clock optical coupler 336. The clock input 328 of the counter 324 is isolated from the reset input 346 by blocking diode Dr. The 1 megohm resistor and 0.47 ufd capacitor in parallel from the reset input 346 to ground act to stretch the clock pulse as applied to the reset terminal 344, and serves to prevent accidental activation by noise or activation of numerous selection switches.

Figure 5:
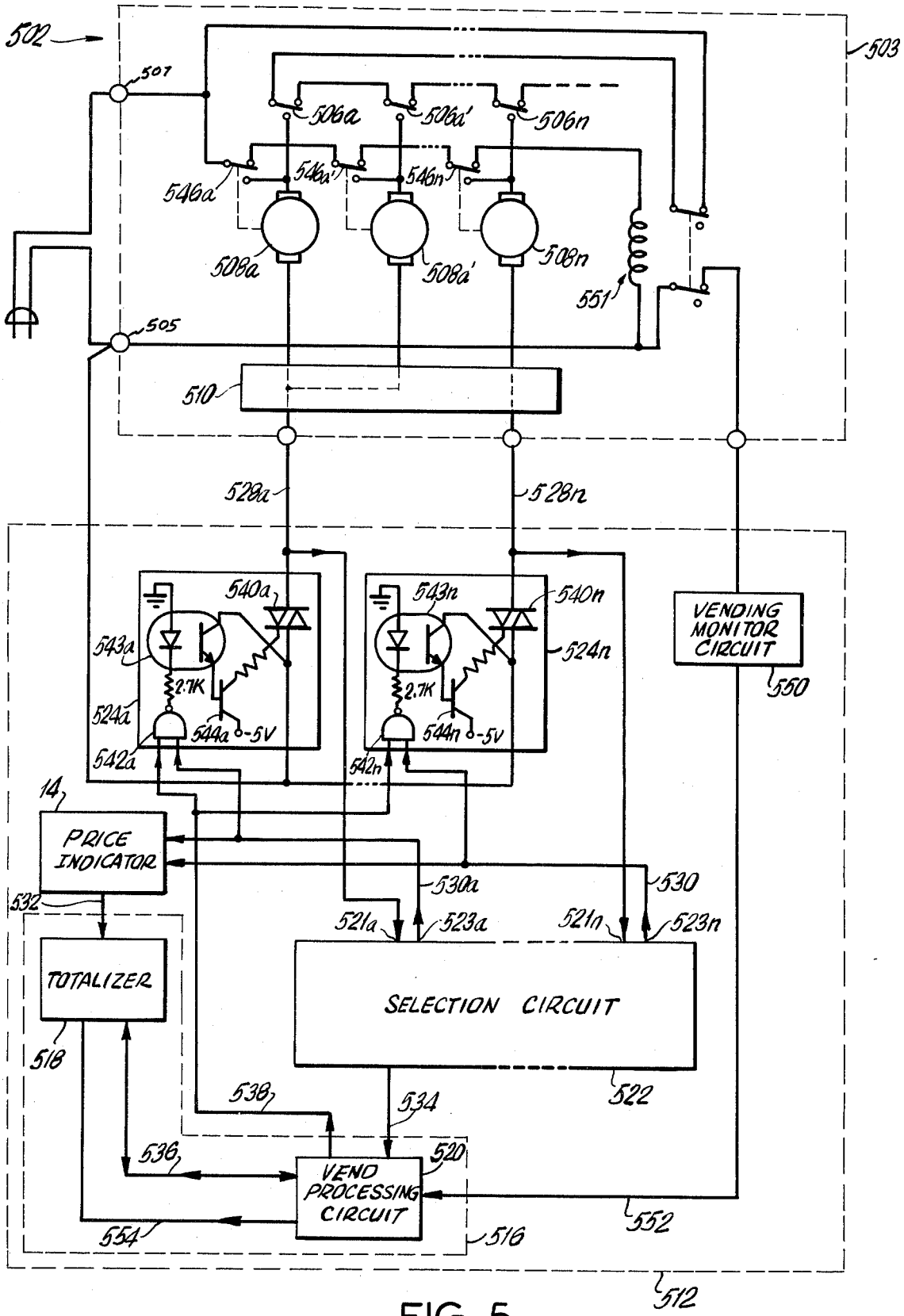
FIG. 5 shows a vending machine including a control apparatus 512 which can employ one of the selection circuits 222 or 322.

FIG. 5 shows a vending machine 502 similar to the vending machine 2 shown in FIG. 1. The vending section 503, unlike the vending section 4 of vending machine 3, operates directly from the alternating current line without the isolation and reduction of voltage afforded by transformer 4. The control apparatus 512 is therefore protected from the high voltage in the vending section 503 by the isolation provided in the selection circuit 522 and in the actuator control circuits 524*a*–524*n*. The selection circuit 522 can be the same as selection circuit 222 or 322, as described above. The remaining elements of the control apparatus 512 can be substantially the same as the corresponding element of the control apparatus 12 of FIG. 1, applying electrical isolation in the known manner when connections are made between the vending section 523 and the control apparatus 512.

The actuator control circuits 524*a*–524*n* employ optical couplers 543*a*–543*n* to isolate the NAND gates 542*a*–542*n*, corresponding to NAND gates 42*a*–42*n*, from the switching devices 540*a*–540*n*. When one of the NAND gates 542*a*–542*n* produces a signal, it drives the corresponding optical coupler 543*a*–543*n* which in turn drives the corresponding transistor 544*a*–544*n* which triggers the corresponding switching device 540*a*–540*n*.

I claim:

1. A vending machine comprising a plurality of alternating current actuators, each individually controlled for the dispensing of a customer selected product;

a selection switch for activation by a customer in selecting the desired product;

an alternating current supply for the actuators, having a first output terminal connected to a common terminal;

selection circuit means responsive to a switch signal from the selection switch for generating a selection signal indicating the product category selected;

credit indicating means for producing a signal indicative of the credit to be accorded to the customer;

price indicating means responsive to the selection signal for producing a signal indicative of the price of the customer selected product;

a calculating section responsive to the credit indicating means and the price indicating means for comparing the amount of customer credit with the price of the selected product and for generating a vend signal in appropriate response thereto;

a direct current power supply for the selection circuit means having one power output terminal connected to the common terminal; and actuator control means responsive to the vend signal from the calculating section for activating the actuator corresponding to the selected produce to dispense the product, the actuator control means including an electronic power switch for activating the corresponding actuator by connecting the actuator to the common terminal.

2. The vending machine of claim 1 wherein the alternating current supply for the actuators has a second output terminal selectively connected to each actuator by the selection switch.

3. The vending machine of claim 1 wherein the selection circuit comprises a plurality of comparator circuits, each comparator circuit including a first input and a second input and an output, with each comparator circuit responsive to a switch signal at its first input to generate a selection signal by altering its output from a first level of output to a second level of output, and with the outputs of the comparator circuits interconnected with the second inputs of the comparator circuits for inhibiting the comparator circuits from generating any further selection signals in response to subsequent receipt of any switch signal.

4. The vending machine of claim 3 wherein the alternating current supply for the actuators has a second output terminal selectively connected to each actuator by the selection switch.

5. The vending machine of claim 1 wherein the selection circuit comprises a step counter means for generating the selection signal in response to the initial receipt of a switch signal, the step counter means including a pulse counter with a plurality of output terminals sequentially activated in response to a clock signal, and a detecting means associated with the pulse counter output terminals for detecting the presence of a switch signal corresponding to one of the pulse counter output terminals and in response generating a selection made signal to halt the pulse counter and maintain the activation of the corresponding pulse counter output terminal.

6. The vending machine of claim 5 wherein the detecting means associated with the pulse counter comprises a plurality of optical couplers, with each pulse counter output terminal having an associated optical coupler with an optical emitter responsive to a switch signal and a detector responsive to an activation of the emitter and to the activation of the associated output terminal to generate the selection made signal.

7. The vending machine of any of claims 1 through 6 wherein the alternating current supply comprises a power transformer having at least one output winding and the common terminal is connected to an output winding of the power transformer.

8. A vending machine comprising a plurality of actuators, each individually controlled for the dispensing of a customer selected product;

a selection switch for activation by a customer in selecting the desired product;

a selection circuit comprising electronic step counter means for generating the selection signal in response to the initial receipt of a switch signal, the step counter means including a pulse counter with a plurality of output terminals sequentially activated in response to a clock signal; and the selection circuit further comprising a detecting means associated with the pulse counter output terminals for detecting the presence of a switch signal corresponding to one of the pulse counter output terminals and in response generating a selection made signal to halt the pulse counter and maintain the activation of the corresponding pulse counter output terminal;

credit indicating means for producing a signal indicative of the credit to be accorded to the customer;

price indicating means responsive to the selection signal for producing a signal indicative of the price of the customer selected product;

a calculating section responsive to the credit indicating means and the price indicating means for comparing the amount of customer credit with the price of the selected product and for generating a vend signal in appropriate response thereto; and actuator control means responsive to the bend signal from the calculating section for activating the actuator corresponding to the selected product to dispense the product, the actuator control means including an electronic power switch for activating the corresponding actuator.

9. The vending machine of claim 8 wherein the detecting means associated with the pulse counter comprises a plurality of optical couplers, with each pulse counter output terminal having an associated optical coupler with an optical emitter responsive to a switch signal and a detector responsive to an activation of the emitter and to the activation of the associated output terminal to generate the selection made signal.

10. The vending machine of claim 8 or 9 wherein the actuators are alternating current actuators.

11. The vending machine of claim 8 or 9 further comprising an alternating current supply for the actuators having a first output terminal connected to a common terminal and a direct current power supply for the selection circuit having one power output terminal connected to the common terminal, wherein the actuators are alternating current actuators and the selected actuator is activated by connecting it to the common terminal.

12. The vending machine of claim 11 wherein the alternating current power supply comprises a power transformer having at least one output winding and the common terminal is connected to an output winding.

13. Control apparatus for a vending machine having a plurality of alternating current actuators, each actuator individually controlled for the dispensing of a customer selected product by the activation of the corresponding actuator; a selection switch for activation by a customer in selecting the desired product; and an alternating current supply for the actuators having a first output terminal connected to a common terminal; the control apparatus comprising:

selection circuit means responsive to a switch for generating a selection signal indicating the product category selected;

credit indicating means for producing a signal indicative of the credit to be accorded to the customer;

price indicating means for producing a signal indicative of the price of the customer selected product;

a calculating section responsive to the credit indicating means and the price indicating means for comparing the amount of customer credit with the price of the selected product and for generating a vend signal in appropriate response thereto;

a direct current power supply for the selection circuit means having one output terminal connected to the common terminal of the vending machine; and actuator control means responsive to the vend signal from the calculating section for activating the actuator corresponding to the selected product to dispense the product, the actuator control means including an electronic power switch for activating the corresponding actuator by connecting the actuator to the common terminal.

14. The vending machine of claim 13 wherein the alternating current supply for the actuators has a second output terminal selectively connected to each actuator by the selection switch.

15. The vending machine of claim 13 wherein the selection circuit comprises a plurality of comparator circuits, each comparator circuit including a first input and a second input and an output, with each comparator circuit responsive to a switch signal at its first input to generate a selection signal by altering its output from a first level of output to a second level of output, and with the outputs of the comparator circuits interconnected with the second inputs of the comparator circuits for inhibiting the comparator circuits from generating any further selection signals in response to subsequent receipt of any switch signal.

16. The vending machine of claim 15 wherein the alternating current supply for the actuators has a second output terminal selectively connected to each actuator by the selection switch.

17. The control apparatus of any of claims 12 through 16 wherein the vending machine alternating current supply comprises a power transformer having at least one output winding and the common terminal is connected to an output winding.

18. Control apparatus for a vending machine having a plurality of actuators, each actuator individually controlled for the dispensing of a customer selected product by the activation of the corresponding actuator; a selection switch for activation by a customer in selecting the desired product; the control apparatus comprising:

a selection switch for activation by a customer in selecting the desired product;

a selection circuit comprising electronic step counter means for generating the selection signal in response to the initial receipt of a switch signal, the step counter means including a pulse counter with a plurality of output terminals sequentially activated in response to a clock signal; and the selection circuit further comprising a detecting means associated with the pulse counter output terminals for detecting the presence of a switch signal corresponding to one of the pulse counter output terminals and in response generating a selection made signal to halt the pulse counter and maintain the activation of the corresponding pulse counter output terminal;

credit indicating means for producing a signal indicative of the credit to be accorded to the customer;

price indicating means responsive to the selection signal for producing a signal indicative of the price of the customer selected product;

a calculating section responsive to the credit indicating means and the price indicating means for comparing the amount of customer credit with the price of the selected product and for generating a vend signal in appropriate response thereto; and actuator control means responsive to the vend signal from the calculating section for activating the actuator corresponding to the selected product to dispense the product, the actuator control means including an electronic power switch for activating the corresponding actuator.

19. The vending machine of claim 18 wherein the detecting means associated with the pulse counter comprises a plurality of optical couplers, with each pulse counter output terminal having an associated optical coupler with an optical emitter responsive to a switch signal and a detector responsive to an activation of the emitter and to the activation of the associated output terminal to generate the selection made signal.

20. The control apparatus of claim 18 or 19 wherein the vending machine actuators are alternating current actuators.

21. The control apparatus of claim 18 or 19 for use with a vending machine having alternating current actuators and an alternating current supply for the actuators having a first output terminal connected to a common terminal, the control apparatus further comprising a direct current power supply for the selection circuit having one power output terminal connected to a common terminal, wherein the selected actuator is activated by connecting it to the common terminal.

22. A selection circuit for a vending machine having a plurality of actuators for the dispensing of a customer selected product and a selection switch for selective activation of an actuator by a customer in selecting the desired product; the selection circuit comprising a plurality of comparator circuits, each comparator circuit including a first and second input and an output, with each comparator circuit responsive to a switch signal at its first input to generate a selection signal by altering its output from a first level of output to a second level of output, and with the outputs of the comparator circuits interconnected with the second inputs of the comparator circuits for inhibiting the comparator circuits from generating any further selection signals in response to subsequent receipt of any switch signal.

23. The selection circuit of claim 22 wherein the vending machine actuators are alternating current actuators.

24. A selection circuit for a vending machine having a plurality of actuators and a selection switch for selective activation of an actuator by a customer in selecting the desired product;

the selection circuit comprising a step counter means for generating the selection signal in response to the initial receipt of a switch signal, the step counter means including a pulse counter with a plurality of output terminals sequentially activated in response to a clock signal, and a detecting means associated with the pulse counter output terminals for detecting the presence of a switch signal corresponding to one of the pulse counter output terminals and in response generating a selection made signal to halt the pulse counter and maintain the activation of the corresponding pulse counter output terminal.

25. The selection circuit of claim 24 wherein the detecting means associated with the pulse counter comprises a plurality of optical couplers, with each pulse counter output terminal having an associated optical coupler with an optical emitter responsive to a switch signal and a detector responsive to an activation of the emitter and to the activation of the associated output terminal to generate the selection made signal.

26. The selection circuit of claim 24 or 25 wherein the vending machine actuators are alternating current actuators.

* * * * *

UNITED STATES PATENT AND TRADEMARK OFFICE

CERTIFICATE OF CORRECTION

PATENT NO. : 4,234,070

DATED : November 18, 1980

INVENTOR(S) : Frederic P. Heiman

It is certified that error appears in the above—identified patent and that said Letters Patent is hereby corrected as shown below:

Delete Figures 1, 3, 4 and 5 and substitute the corrected figures 1, 3, 4 and 5.

On the title page Figure 1 should appear as the descriptive figure.

Signed and Sealed this

*Twenty-first* Day of *July 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,234,070

DATED : November 18, 1980

INVENTOR(S) : Frederic P. Heiman

It is certified that error appears in the above—identified patent and that said Letters Patent is hereby corrected as shown below:

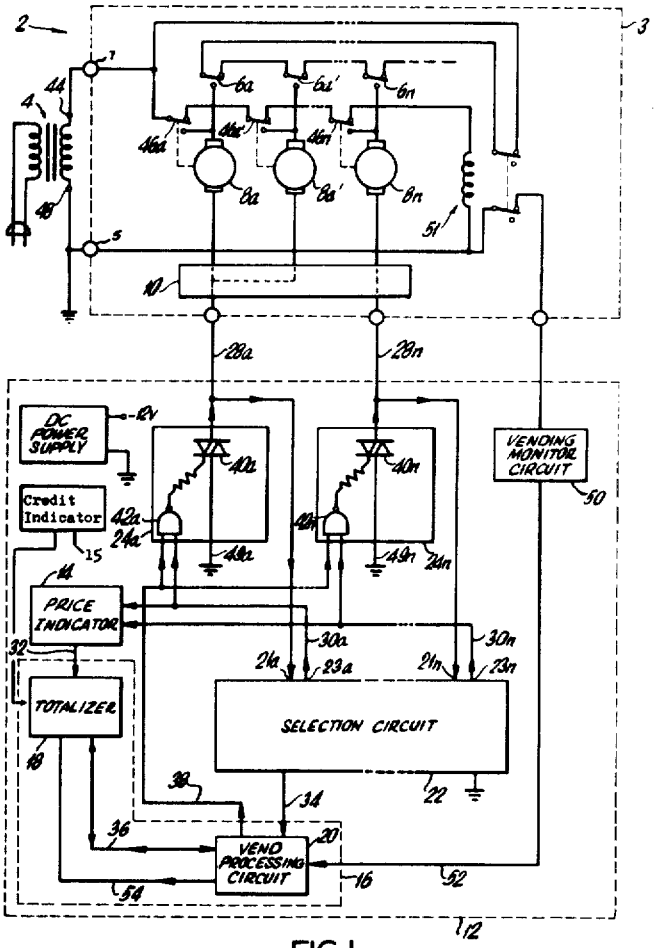

FIG.1

UNITED STATES PATENT AND TRADEMARK OFFICE

CERTIFICATE OF CORRECTION

PATENT NO. : 4,234,070

DATED : November 18, 1980

INVENTOR(S) : Frederic P. Heiman

It is certified that error appears in the above—identified patent and that said Letters Patent is hereby corrected as shown below:

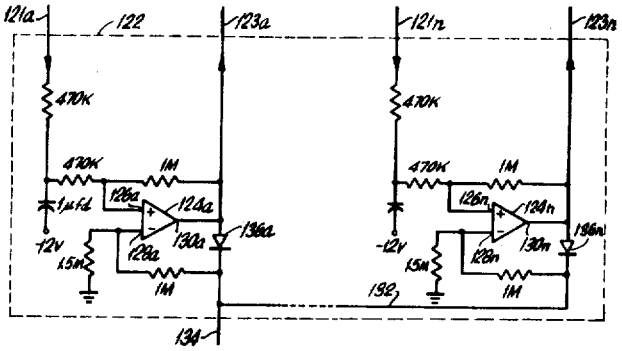

FIG.2

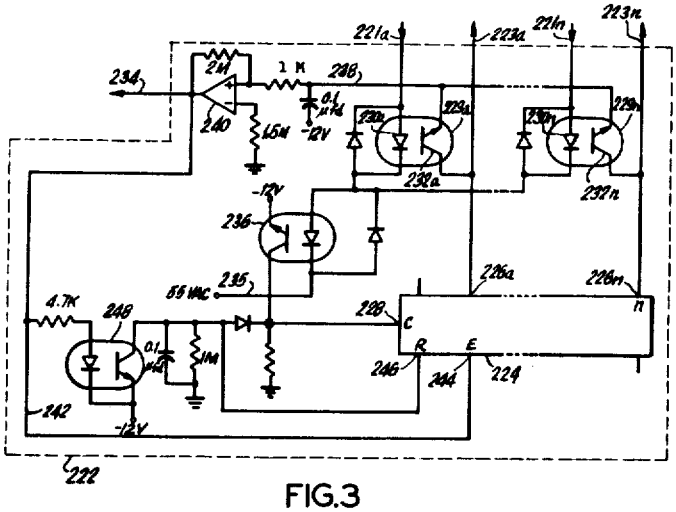

FIG.3

UNITED STATES PATENT AND TRADEMARK OFFICE

CERTIFICATE OF CORRECTION

PATENT NO. : 4,234,070

DATED : November 18, 1980

INVENTOR(S) : Frederic P. Heiman

It is certified that error appears in the above—identified patent and that said Letters Patent is hereby corrected as shown below:

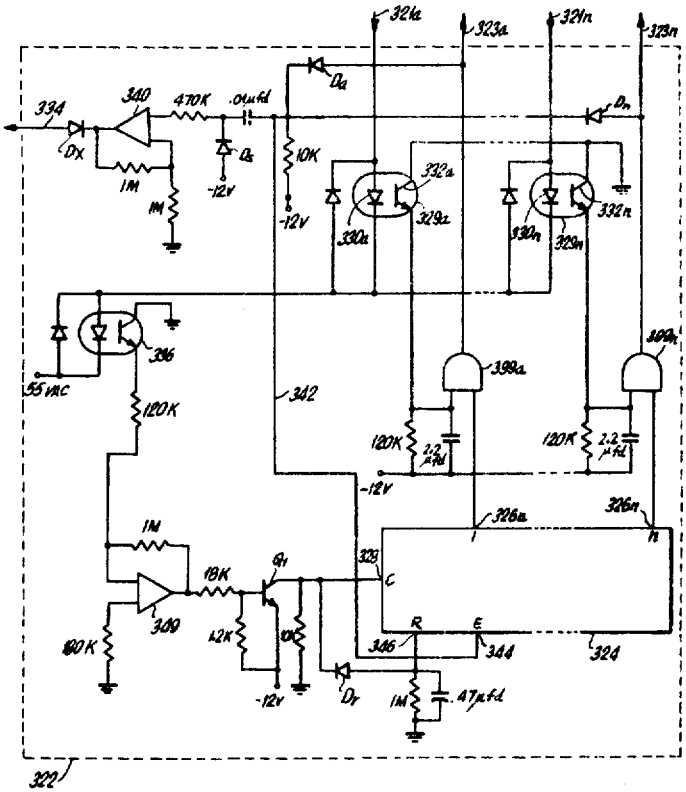

FIG. 4

UNITED STATES PATENT AND TRADEMARK OFFICE

CERTIFICATE OF CORRECTION

PATENT NO. : 4,234,070

DATED : November 18, 1980

INVENTOR(S) : Frederic P. Heiman

It is certified that error appears in the above—identified patent and that said Letters Patent is hereby corrected as shown below:

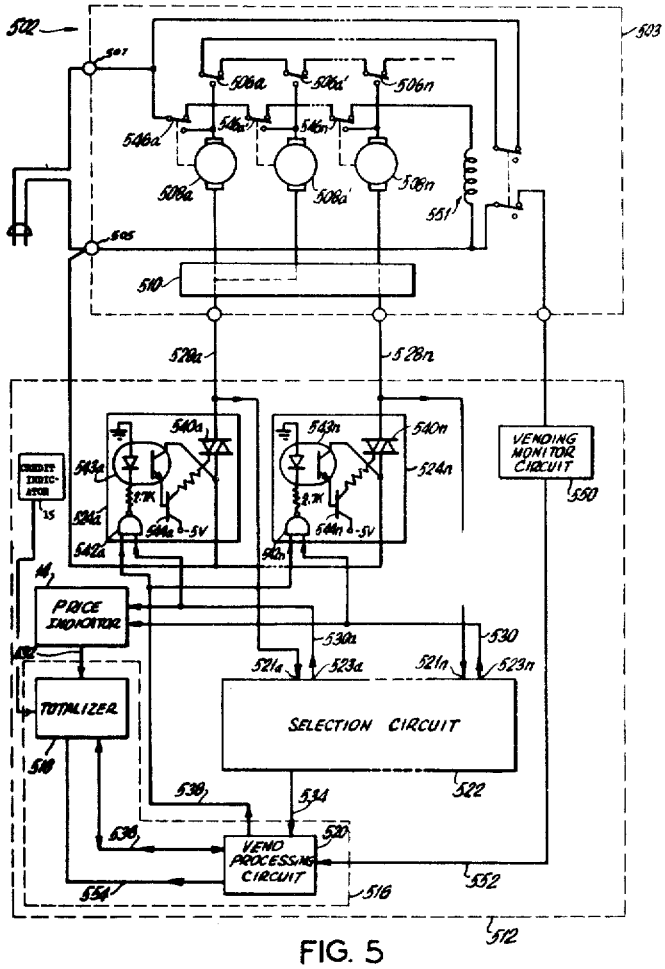

FIG. 5